US007147022B2

(12) United States Patent
Le Devehat

(10) Patent No.: US 7,147,022 B2
(45) Date of Patent: Dec. 12, 2006

(54) ASSEMBLY WITH ARTICULATED ARM FOR LOADING AND UNLOADING PRODUCTS, IN PARTICULAR FLUID PRODUCTS

(75) Inventor: Renaud Le Devehat, Thorigny-sur-Oreuse (FR)

(73) Assignee: FMC Technologies, S.A., Sens (FR)

( * ) Notice: Subject to any disclaimer, the term of this patent is extended or adjusted under 35 U.S.C. 154(b) by 799 days.

(21) Appl. No.: 10/380,648

(22) PCT Filed: Sep. 13, 2001

(86) PCT No.: PCT/FR01/02846

§ 371 (c)(1),
(2), (4) Date: Mar. 14, 2003

(87) PCT Pub. No.: WO02/22491

PCT Pub. Date: Mar. 21, 2002

(65) Prior Publication Data

US 2004/0099336 A1 May 27, 2004

(30) Foreign Application Priority Data

Sep. 14, 2000 (FR) ..... 00 11748

(51) Int. Cl.
*B65B 1/04* (2006.01)

(52) U.S. Cl. ..... 141/387; 141/98; 137/615; 212/310

(58) Field of Classification Search ..... 141/98, 141/387; 137/615; 222/526, 533; 212/307, 212/309, 310
See application file for complete search history.

(56) References Cited

U.S. PATENT DOCUMENTS

| | | | | |
|---|---|---|---|---|
| 3,249,121 | A | 5/1966 | Bily | |
| 4,142,551 | A * | 3/1979 | Wilms | 137/615 |
| 4,299,261 | A | 11/1981 | Talafuse | |

FOREIGN PATENT DOCUMENTS

| | | |
|---|---|---|
| EP | 0 323 355 A1 | 7/1989 |
| FR | 2 368 434 | 5/1978 |
| GB | 1 591 646 | 6/1981 |

* cited by examiner

*Primary Examiner*—Timothy L. Maust

(57) ABSTRACT

The invention concerns an assembly comprising balanced loading and unloading arm (14) installed at a first location and having articulated pipeline arms (15, 16) mounted through one of its end on a base (18) and provided at the other of its ends with a system connecting (28) the articulated pipeline arms to coupling means (29) installed at the second location. It further comprises a cable (32) linked through one of its ends to the connecting system (28) and through the other of its ends to means (35–39) adapted to subject said cable to constant tension, and a connecting winch (42) whereon is wound a connection cable (41) for bringing the connecting system (28) in a position to be connected to the coupling means (29).

8 Claims, 4 Drawing Sheets

ASSEMBLY WITH ARTICULATED ARM FOR LOADING AND UNLOADING PRODUCTS, IN PARTICULAR FLUID PRODUCTS

BACKGROUND OF THE INVENTION

The present invention is directed to an articulated arm for loading and unloading products, in particular fluid products such as, for example, liquefied natural gas.

More particularly it relates to a balanced loading arm equipped with a hydraulic coupling allowing a transfer to be carried out between two vessels moored side-by-side, between a vessel and a platform or a floating barge moored side-by-side, or also between a jetty on which the loading arm is installed and a vessel moored alongside this jetty.

An example of this type of arm is described in the document GB-2 042 466. The connection of the end of this arm to a coupling means provided on the vessel is difficult, even impossible to carry out in difficult sea conditions. Moreover, under these conditions, the risk of impacts between this end and the coupling means is significant. In the majority of cases, these impacts lead to damage to the components constituting the end of the arm or the coupling means.

An aim of the invention is to overcome these drawbacks. In particular it aims to allow the connection/disconnection of a loading arm to/from a vessel in difficult sea conditions.

SUMMARY OF THE INVENTION

To this end, the present invention provides an assembly for loading and unloading products which comprises a balanced loading and unloading arm which is installed at a first site and includes a compass-style duct system, one end of which is mounted on a base and the other end of which is provided with a connection system for connecting the compass-style duct system to a coupling means that is installed at a second site. In particular, the invention comprises a first cable which is secured between the connection system and a means for subjecting the first cable to a constant tension, a connection winch which is attached to the connection system, and a second cable which is wound upon the connection winch and is connectable to the coupling means. In operation, the second cable is wound upon the connection winch to thereby bring the connection system into engagement with the coupling means against the constant tension exerted on the connection system by the first cable and the constant tension means.

Thus, the present invention provides an answer to the requirements which have just been mentioned. In fact, the invention allows the connection system to approach the coupling means installed at a site which is moving, such as a vessel, and to make a connection under good conditions.

Other characteristics and advantages of the invention will emerge from the following description, given with reference to the attached drawings.

DETAILED DESCRIPTION OF THE PREFERRED EMBODIMENTS

Figure 1:
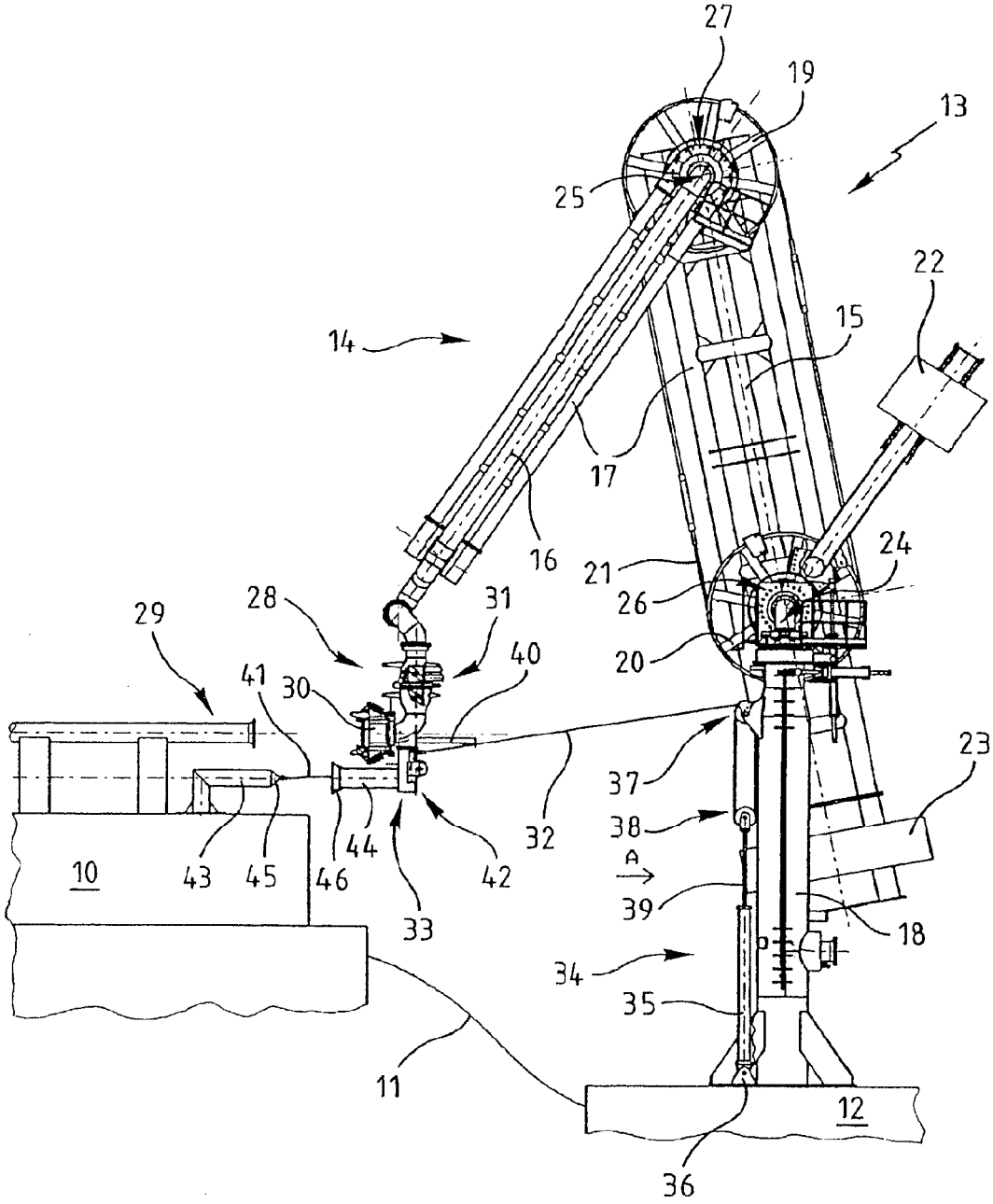
FIG. 1 is a side elevation view of a loading/unloading assembly in accordance with an embodiment according to the invention.
Figure 2:
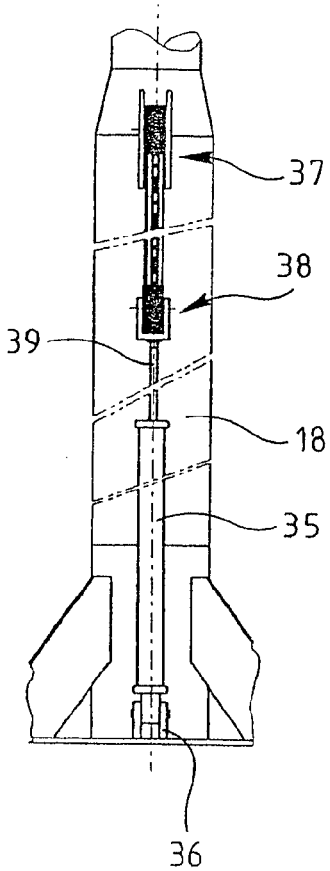
FIG. 2 is a broken view as seen from the direction of arrow A of FIG. 1.

FIG. 1 shows a tanker numbered 10 which is moored by means of a mooring rope 11 to a jetty 12 being situated alongside the latter. A fluid loading and unloading assembly 13 according to an embodiment of the invention allows the transfer, in this case of liquefied natural gas, from the tanker 10 to tanks installed on the jetty 12 or close by it and connected to the fluid transfer assembly 13, or vice versa.

To this end, the assembly 13 comprises a loading and unloading arm 14 having a compass-style duct system comprising an internal tube 15 and an external tube 16 and carried by a compass-style support 17 with two branches resting on a common base 18.

This arm 14 is, in this case, balanced by means of a counterweight system comprising two pulleys 19 and 20, connected to each other by means of a cable 21, and two counterweights 22 and 23. The counterweight 22 is mounted on the pulley 20, whilst the counterweight 23 is mounted on the branch of the compass-style structure 17 supported by the base 18.

A fixed duct runs along the interior of the base 18 and is connected to internal tube 15 by an articulation 24 comprising two 90° bends and two swivel joints, in this case, cryogenic and of the Chiksan® swivel joint type.

An articulation 25 comprising two bends and a swivel joint allows the internal tube 15 to be connected to the external tube 16.

The articulation between the branches of the compass-style support 17 and between this compass and the base 18 is realised by means of ball bearings 26 and 27, surrounding the articulations 24 and 25 respectively.

Hydraulic jacks, which cannot be seen in FIG. 1, allow the loading and unloading arm 14 to be manoeuvred.

A connection system 28 allows the external tube 16 to be connected to a coupling means formed by a manifold 29 situated on the tanker 10.

This connection system 28 comprises a hydraulic coupling 30 connected by bends and swivel joints to the external tube 16. The conduit section formed by these bends and swivel joints is, moreover, provided with an emergency disconnection system 31.

The loading and unloading assembly 13 as has just been described is well known to a person skilled in the art and will not therefore be described in greater detail here.

In accordance with the invention, a cable 32 is connected at one of its ends to a support 33 firmly fixed to the connection system 28.

The other end of this cable 32 is connected to means 34 suitable for subjecting it to a constant tension.

These means 34 comprise a double-acting hydraulic jack 35 fixed, in this case, to the jetty 12 by means of a clevis mounting 36. It extends parallel to the base 18.

The means 34 also comprise two sets of pulleys 37 and 38, each having two return pulleys around which the cable 32 is wound.

The set of pulleys 38 is fixed by its clevis mounting to the piston rod 39 of jack 35, whilst the clevis mounting of the pulley set 37 is fixed to the base 18. It is therefore possible to multiply the range of the cable 32 by eight.

To apply a constant tension to the cable whatever its speed and its length over which it extends between the base 18 and the support 33, the jack 35 is fed at a constant hydraulic pressure.

A rod 40, fixed to support 33 and provided with a ring through which the cable 32 passes, moreover, allows the connection system 28 to be maintained in alignment with the cable 32 and a connection cable 41 allowing the connection system 28 to be brought into the position of connection to the manifold 29.

This connection cable 41 is wound on a winch 42, operating at constant speed, which is also fixed to support 33.

It should be noted, in this respect, that the greater the distance between the points of attachment of the cables 32 and 41 to the connection system 28, the better the alignment of this system 28 as regards these cables 32 and 41 is. As can be seen in FIG. 1, the rod 40 allows this distance to be increased.

Given that the cable 32 is attached to the support 33, the tensile load is not entirely applied to this alignment rod 40. In fact, only a lateral component is applied to this rod 40 when the connection system 28 is out of alignment.

Two tube sections 43 and 44, one entering the other, allow the connection system 28 to be guided when this arrives close to the flange of manifold 29.

The male section 43 is mounted on the tanker 10 and extends under manifold 29. Its front end, to which the connection cable 41 is going to be fastened, is situated in front of the flange of manifold 29.

The female section 44 is traversed by the connection cable 41 and fixed to support 33, under the hydraulic coupling 30. The free end of this female section 44, is, on its side, situated in front of the hydraulic coupling 30.

Thus the possibility of impacts between the connector 30 and the flange of manifold 29 is limited.

Moreover, each free end of guide tube sections 43 and 44 is formed by a centring cone 45, 46.

Furthermore, the internal diameter of female tube section 44 is greater than the external diameter of male tube section 43, so as to avoid any risk of jamming.

Once these two guide tube sections 43 and 44 are engaged in each other, the only movement that is still possible between the hydraulic coupling 30 and the flange of manifold 29 results from the play between these two tubes. This movement is easily compensated for by the guide means which exist on the hydraulic coupling 30.

It should also be noted that a rope, which is not visible in the figures, is used to bring the connection cable 41 to the front end of tube section 43, at the start of the connection procedure.

During this connection procedure, the loading and unloading arm 14 is put in "free wheel" by commoning the chambers of the hydraulic manoeuvring jacks of this arm 14. Preferably, in order to limit the oscillations of the arm, a flow limiter is used on the hydraulic line extending between the two chambers of each of these jacks.

Figure 3:
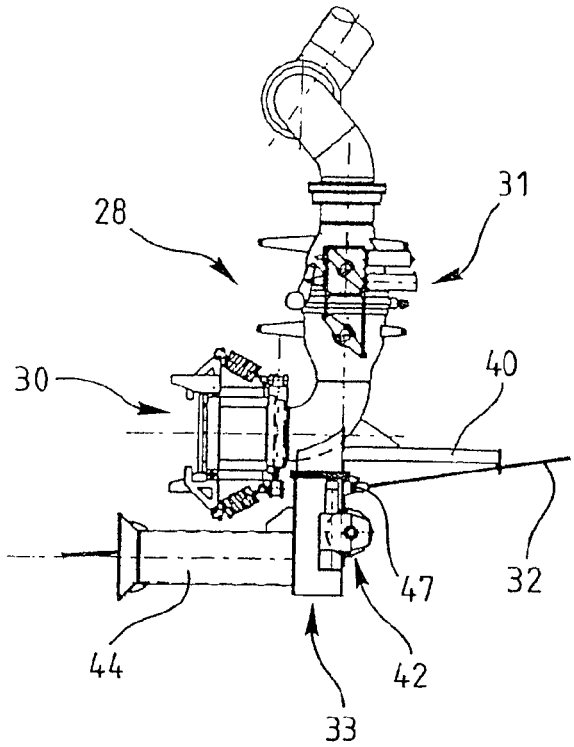
FIG. 3 is an enlarged side elevation view of the connection system of the assembly of FIG. 1.

Finally, a hydraulic jack of an emergency disconnection system allows the cable 32 to be detached from support 33 by withdrawing a pin 47 (see FIG. 3) from a pin holder fixed to support 33 and a ring at the end of cable 32.

This jack is not represented in the figures as it is in alignment with pin 47.

Figure 6:
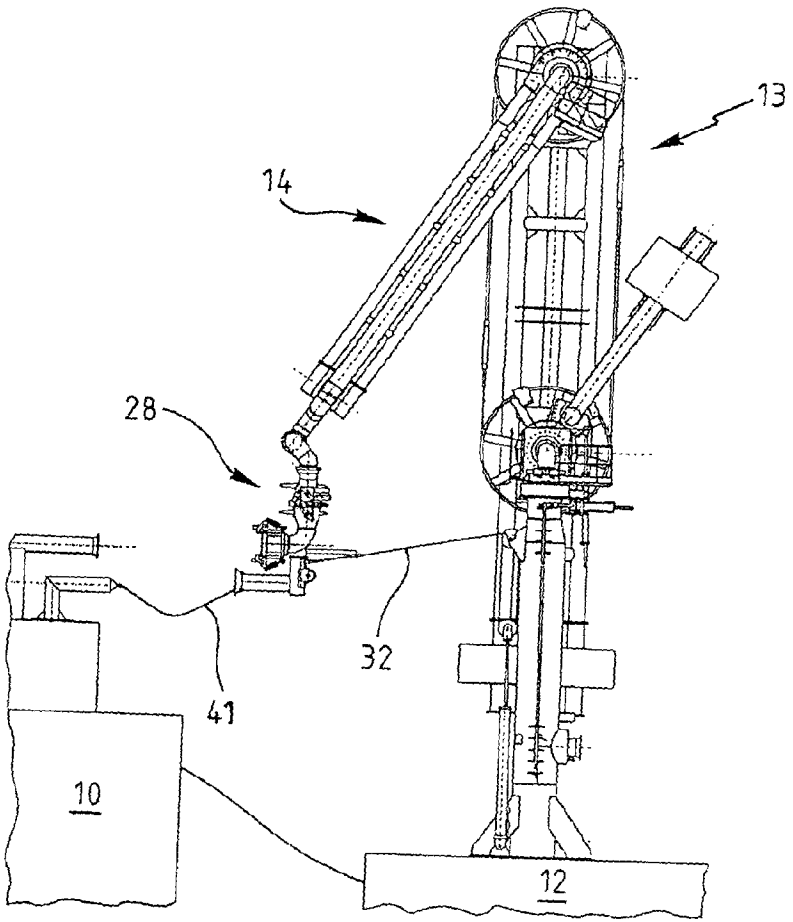
FIGS. 5 to 8 are side elevation views of the assembly of FIG. 1, which show certain stages of the procedure for connecting the loading and unloading arm of this assembly to a coupling means.
Figure 5:
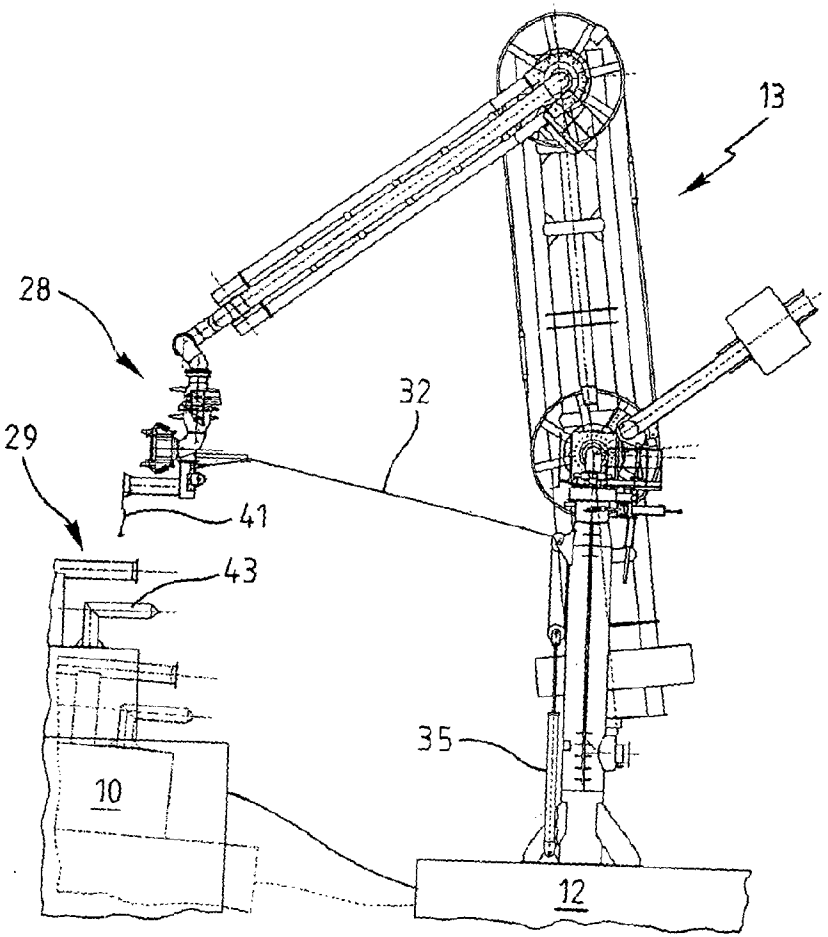
Figure 7:
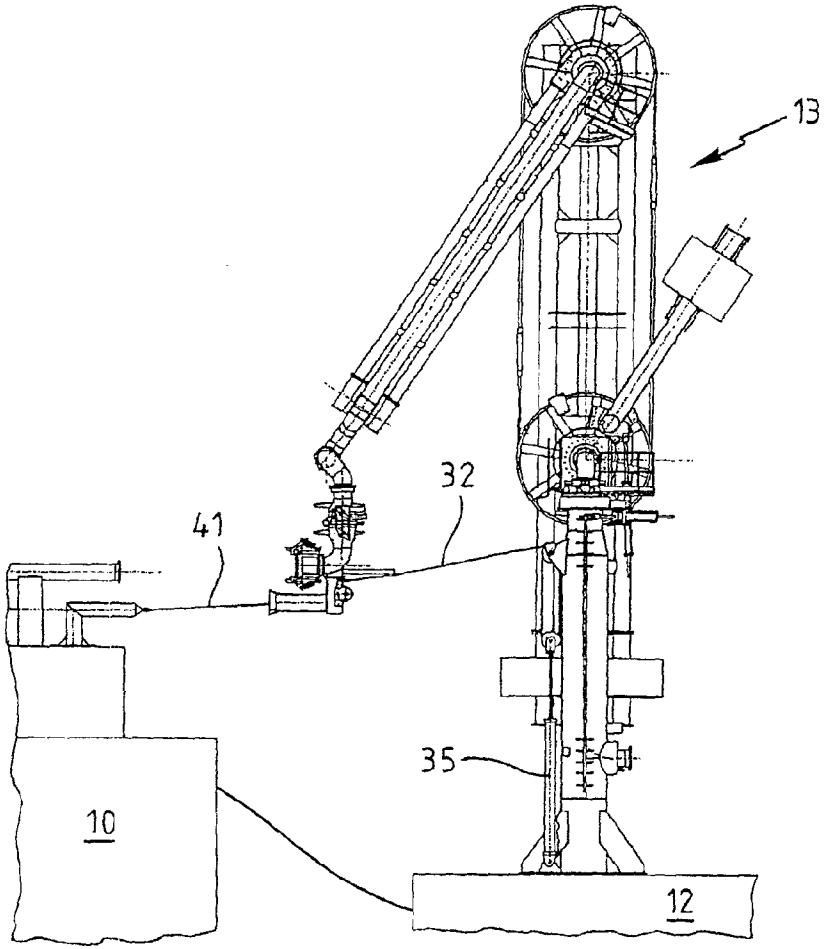

The connection procedure is as follows:

1) An operator firstly uses a remote control panel to raise the connection system 28 above manifold 29 (see FIG. 5). A reduced pressure can be applied to jack 35 to avoid any slackening of cable 32 during this phase. Then the connection cable 41 is unwound from winch 42 and it is brought to the end of guidance section 43 by means of the messenger line in order to fix it to it (see FIG. 6).
2) As shown in this FIG. 6, the loading arm 14 is then manoeuvred into an intermediate position between the stored state and the connection state and the "free wheel" mode of this arm is actuated.
3) The cable 32 is then activated by the application of a constant pressure to hydraulic jack 35 (see FIG. 7).

This action is impossible if arm 14 is not in "free wheel" mode.

4) The connection winch 42 is then actuated so as to shorten the length of unwound connection cable 41 and to allow the engagement of guide sections 43 and 44 (see FIG. 1). At the same time, the cable 32 is subjected to a constant tension.

Thus, the closer the loading arm 14 is to manifold 29, the better it follows the movements of vessel 10 which can be seen in FIG. 5. The final alignment is effected before the hydraulic coupling 30 reaches the flange of this manifold 29.

Figure 8:
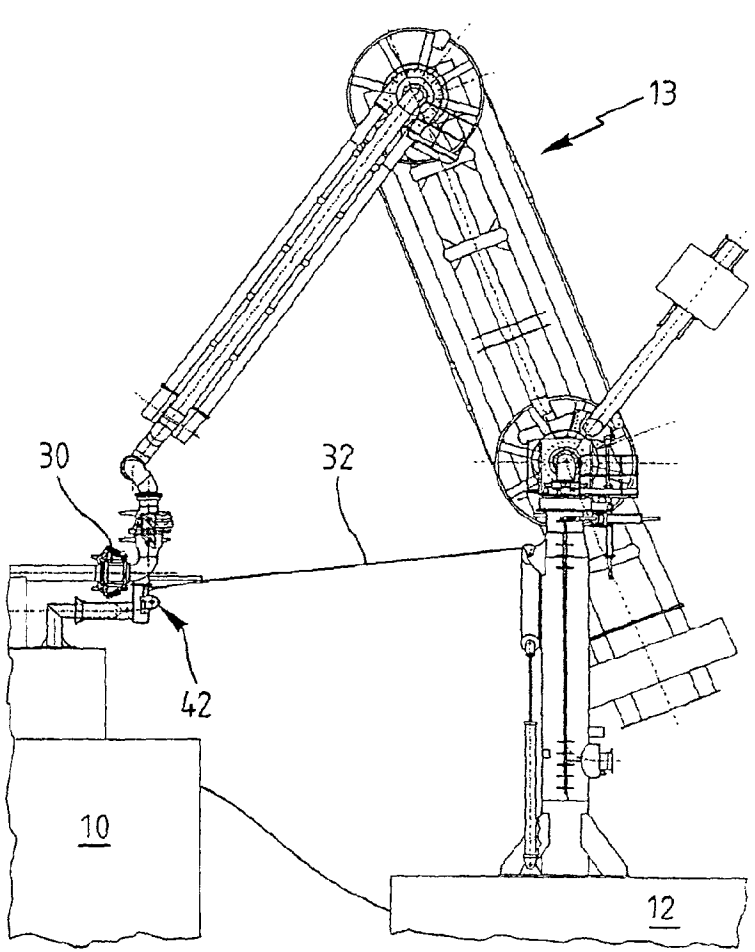

5) As shown in FIG. 8, the hydraulic coupling 30 is then connected to the flange of manifold 29 and a hydraulic limiting valve automatically stops the connection winch 42.

Before the loading and unloading operations can start, the tension applied to cable 32 is reduced to the minimum necessary to keep the cable taut.

Moreover, the emergency disconnection systems are armed.

The cooling, loading and unloading sequences can then start.

The disconnection process follows the same logic, in a reverse sequence.

It will be appreciated that, thanks to the loading and unloading assembly 13 according to the invention, it is possible to carry out a connection or disconnection procedure smoothly and in difficult sea conditions.

Moreover, it is not necessary to carry out significant modifications to an existing assembly in order to make it conform to the invention.

Neither is it necessary to use complex means.

Finally, the connection and disconnection procedures do not depend on the dexterity of the operator and can be carried out with relatively large movements.

In the case of the embodiment of FIGS. 1 to 8, the support 33 and the elements which are fixed to it are arranged under the hydraulic coupling 30.

Figure 4:
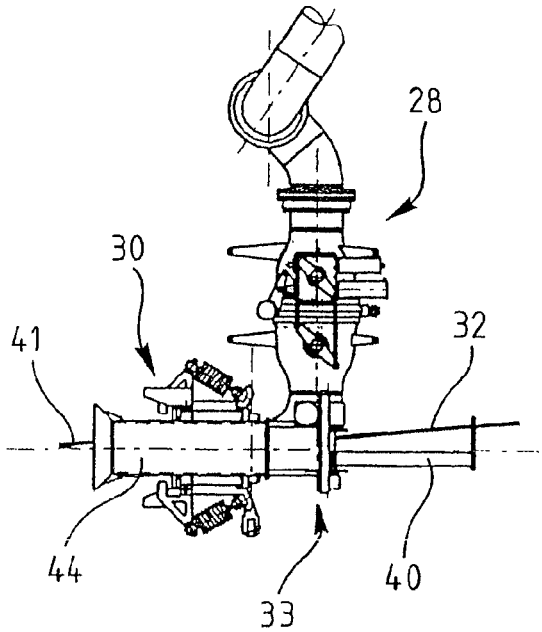
FIG. 4 is a view similar to that of FIG. 3 and shows a connection system in accordance with a preferred embodiment of the invention.

This support 33 is however, preferably placed alongside hydraulic coupling 30, as shown in FIG. 4. This solution offers the following advantages:

- the male guide section 43 being placed parallel to and alongside manifold 29, it is possible to provide an access platform to manifold 29 and the free space under the manifold 29 allows maintenance operations to be carried out on the tanker 10;
- reduced movements of the hydraulic coupling 30, because the axis of the connection cable 41 is placed at the same level (in the vertical direction) as the axis of this coupling 30.

In another embodiment, the hydraulic jack 35 can be replaced by a winch actuated by a hydraulic transmission fed at a constant hydraulic pressure.

Furthermore, the loading and unloading assembly 13 can be of the self-supporting compass-style duct system type and the balancing can be effected with different means.

Of course, the invention is in no way limited to the embodiments described and represented, which are given only by way of examples.

In particular, it includes all the means constituting technical equivalent of the means described, as well as their combinations.

Furthermore, the assembly 13 according to the invention can be used for transferring fluids other than liquefied natural gas. Among these fluids, liquefied petroleum gas and the condensates can be mentioned in particular.

The invention claimed is:

1. An assembly for loading and unloading products which comprises:

a balanced loading and unloading arm which is installed at a first site and which includes a compass-style duct system, one end of which is mounted on a base and the other end of which is provided with a connection system for connecting the duct system to a coupling means that is installed at a second site;

a first cable which is secured between the connection system and means for subjecting the first cable to a constant tension;

a connection winch which is attached to the connection system; and a second cable which is wound upon the connection winch and is connectable to the coupling means;

wherein the second cable may be wound upon the connection winch to thereby bring the connection system into engagement with the coupling means against the constant tension exerted by the first cable and the constant tension means.

2. The assembly according to claim 1, wherein the constant tension means comprises a hydraulic jack.

3. The assembly according to claim 2, wherein the first cable is connected to the hydraulic jack via two sets of pulleys around which the first cable is wound.

4. The assembly according to claim 1, wherein the connection system comprises a hydraulic coupling, the coupling means comprises a manifold, and the hydraulic coupling is connectable with the manifold.

5. The assembly according to claim 1, further comprising a guide tube section which is installed at the second site and which is mateable with a tube section that is fixed to the connection system.

6. The assembly according to claim 1, further comprising an emergency disconnection system.

7. The assembly according to claim 1, further comprising an alignment rod which is fixed to the connection system and which includes a ring through which the first cable passes.

8. The assembly according to claim 1, wherein the constant tension means comprises a winch which is actuated by a hydraulic transmission that is fed at a constant hydraulic pressure.

* * * * *